United States Patent [19]

Haverstock et al.

[11] Patent Number: 4,520,683

[45] Date of Patent: Jun. 4, 1985

[54] PUMP JACK SLANT WELLS

[75] Inventors: Wayne Haverstock, Daysland; David Krywchuk, Lloydminster; Peter Masak, Scarborough, all of Canada

[73] Assignee: Universal Industries Ltd., Lloydminster, Canada

[21] Appl. No.: 488,350

[22] Filed: Apr. 25, 1983

[51] Int. Cl.[3] ..... F16H 21/32; G05G 1/04; G05G 1/00; E21B 19/00

[52] U.S. Cl. ..... 74/41; 74/522; 74/56; 254/27 R

[58] Field of Search ..... 74/41, 522, 586; 175/61, 73; 166/75 A, 68, 77; 254/29 R, 30, 31

[56] References Cited

U.S. PATENT DOCUMENTS

| | | | |
|---|---|---|---|
| 1,494,768 | 5/1924 | Bloss et al. | 74/522 |
| 1,897,108 | 2/1933 | Black | 74/41 |
| 1,979,803 | 11/1934 | Livingston | 74/41 |
| 2,035,525 | 3/1936 | Bloss | 74/522 |
| 2,134,326 | 10/1938 | De La Mater | 74/41 |
| 2,197,730 | 4/1940 | Mugford | 74/41 |
| 2,889,135 | 6/1959 | Tennyck | 254/29 R |
| 3,006,201 | 10/1961 | Ross | 74/41 |
| 3,371,554 | 3/1968 | McCray et al. | 74/41 |
| 3,598,190 | 8/1971 | Pfau | 175/61 |
| 4,027,734 | 6/1977 | Horvath | 175/61 |
| 4,051,736 | 10/1977 | Jones | 74/41 |
| 4,068,729 | 1/1978 | Peevey | 175/61 |

*Primary Examiner*—Allan D. Herrmann
*Assistant Examiner*—Stephen B. Andrews
*Attorney, Agent, or Firm*—E. P. Johnson

[57] ABSTRACT

The pump jack is of conventional API front-mounted geometry Class III configuration, but is provided with an angularly disposed walking beam, so as to be able to pump a slant rod string. To incorporate versatility into the unit so that a single model can be used with different wells having different angularities, there is provided: means for altering the effective length of the Pitman arms (so that the angularity of the walking beam is changed, which permits the unit to be used with a rod string having a different slant); means for bringing the counterweight into phase with the well load; and means for altering the stroke length.

4 Claims, 11 Drawing Figures

15° — - - — - - — 64" STROKE
15° ——— 74" STROKE

PUMP JACK SLANT WELLS

FIELD OF THE INVENTION

This invention relates to a pumping unit of the type used to reciprocate a rod string in a well bore. The pumping unit is particularly adapted for use in connection with slant wells.

BACKGROUND OF THE INVENTION

The present invention has been developed for use with the slant wells currently being drilled to exploit shallow heavy oil deposits, such as those in the vicinity of Bonnyville, Alberta.

The adoption of slant wells has come about in connection with thermal projects. Where steam is being injected into the producing formation, it is desirable to locate the wells as close to the steam generating facility as possible. This has led to the conception of grouping the well heads at the site of the steam generator and drilling directionally from that point to the subsurface target. As the wells are usually quite shallow and the needed angularity of the well bore is quite large, conventional whip-stocking of a well initiated at surface in a vertical direction has not been found suitable. This has led to the drilling of wells slanted right from surface using specially built slant rigs.

The present pumping unit has been developed to reciprocate the rod string used in such a slant well bore.

In designing the pumping unit, several requirements should be taken into account.

Firstly, the wells at a site will normally be drilled at different angles. These well bore angles might vary anywhere from 0° to 40° from vertical. Therefore it is desirable that the pumping unit be adjustable, to accommodate these variations.

Secondly, the pumping unit has to provide ample clearance around the well head in both the vertical and horizontal directions. The well head equipment on a thermal well is usually quite bulky and thus the horsehead has to be located at a relatively high position. Also, since the well head could be rearwardly slanted, the pumping unit base and crank have to be far enough removed so as not to interfere with the well head.

Thirdly, as is true of any pumping unit, it should be light in weight, efficient, and characterized by good torque and rod loading performance.

SUMMARY OF THE INVENTION

In accordance with the broadest aspect of the invention, a pumping unit, having an API front-mounted geometry Class III configuration, is modified so that the unit's walking beam is disposed at a downward or upward angle from horizontal in the mid-stroke position. The novel combination of the Class III configuration and the slanted walking beam is characterized by good torque and rod loading performance and is adapted for use with a slant well.

The Class II configuration is exemplified in FIG. 1, wherein the walking beam is pivoted at its rear end and reciprocated at its front end.

In a preferred feature, the unit is modified to provide for adjustability of the effective length of its Pitman arms. (This effective length is taken to be that between the connection of the lower end of the Pitman arm and the unit's crank arm and the upper end of the Pitman arm and the walking beam.) By varying the effective length of the Pitman arms, the angularity of the walking beam can be changed to handle a rod string in a well bore of different slant.

In another preferred feature, means are provided for bringing the counterweight of the unit into phase with the well rod string load for different well angles.

In another preferred feature, means are provided for altering the stroke length of the unit.

When these features are provided in a pumping unit, a single model of the unit is adapted for use with slant wells having various angularities and depths. Broadly stated, the invention is an improvement in a pumping unit for reciprocating a rod string in a wellbore which is slanted at an angle from vertical, said unit having a Samson post assembly, a walking beam pivotally mounted at its rear end on the Samson post assembly, a pair of Pitman arms, pivotally connected at their upper ends to the front end of the walking beam by a pin and hole means, for supporting said beam and rocking it through a predetermined stroke, rotating crank arms for biasing said Pitman arms, said crank arms each being pivotally connected at one end by pin and hole means to the lower end of one of the Pitman arms, the length of the Pitman arms between their pivot connections with the walking beam and the crank arms being their effective length, counterweight means attached to the crank arms at the latter's ends remote from the Pitman arms connection, and means for rotating said crank arms. The improvement comprises: said walking beam being disposed downwardly at an angle from horizontal when said beam is at the mid-point of its stroke; one of said walking beam and pair of Pitman arms having a plurality of pin holes formed in spaced apart arrangement along a plane generally coinciding with the axis of the Pitman arms, whereby the effective length of the Pitman arms may be adjusted by altering the location of the pins interconnecting the Pitman arms with the walking beam, to thereby vary the downward angle of the walking beam.

DESCRIPTION OF THE DRAWINGS

FIGS. 4(*b*) and (*c*) are similar to FIG. 4(*a*) except that the location of the interconnection between Pitman arm and walking beam is changed, thereby further altering the angularity of the walking beam;

DESCRIPTION OF THE PREFERRED EMBODIMENT

Figure 1:
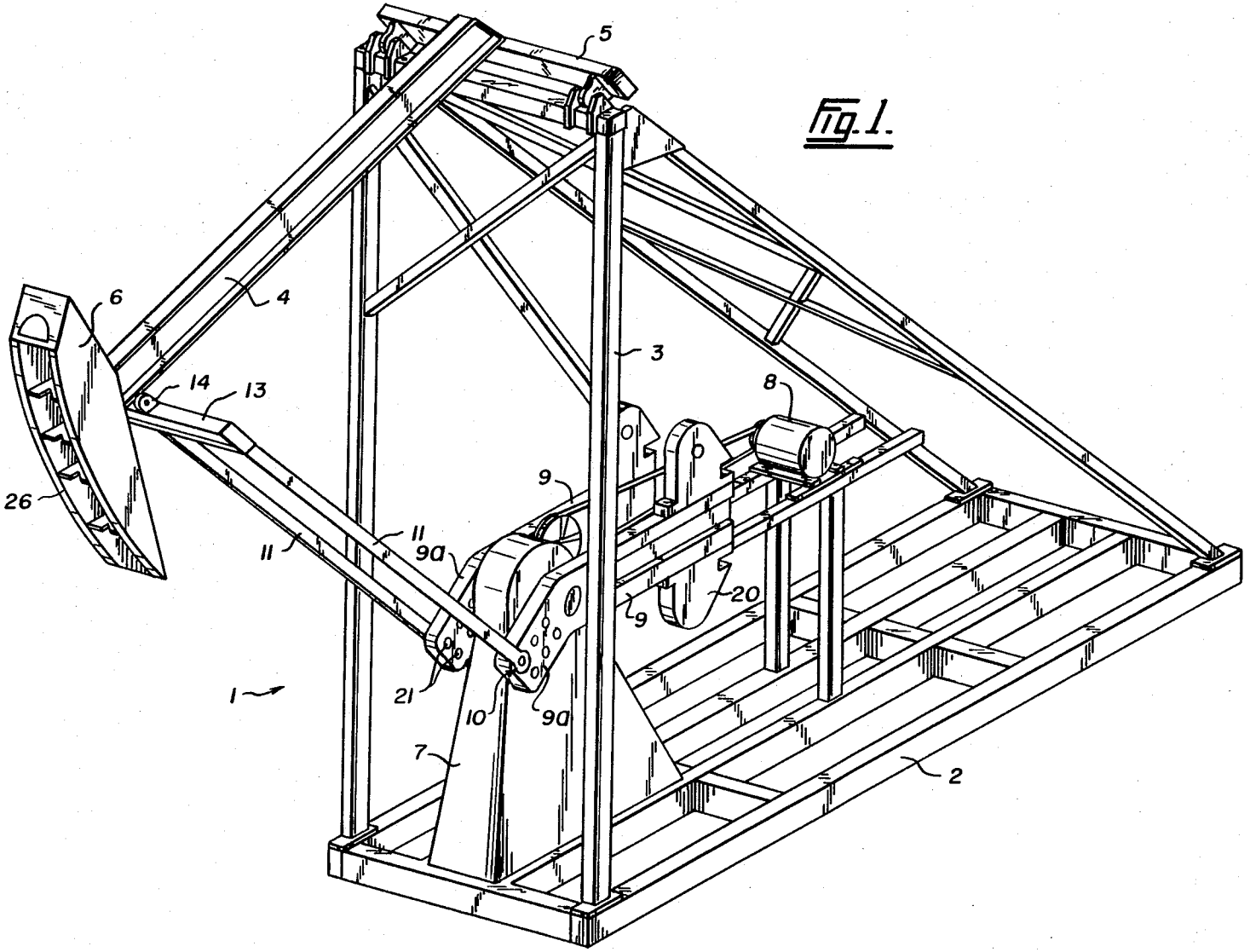
FIG. 1 is a perspective view of the preferred form of the pumping unit.
Figure 2:
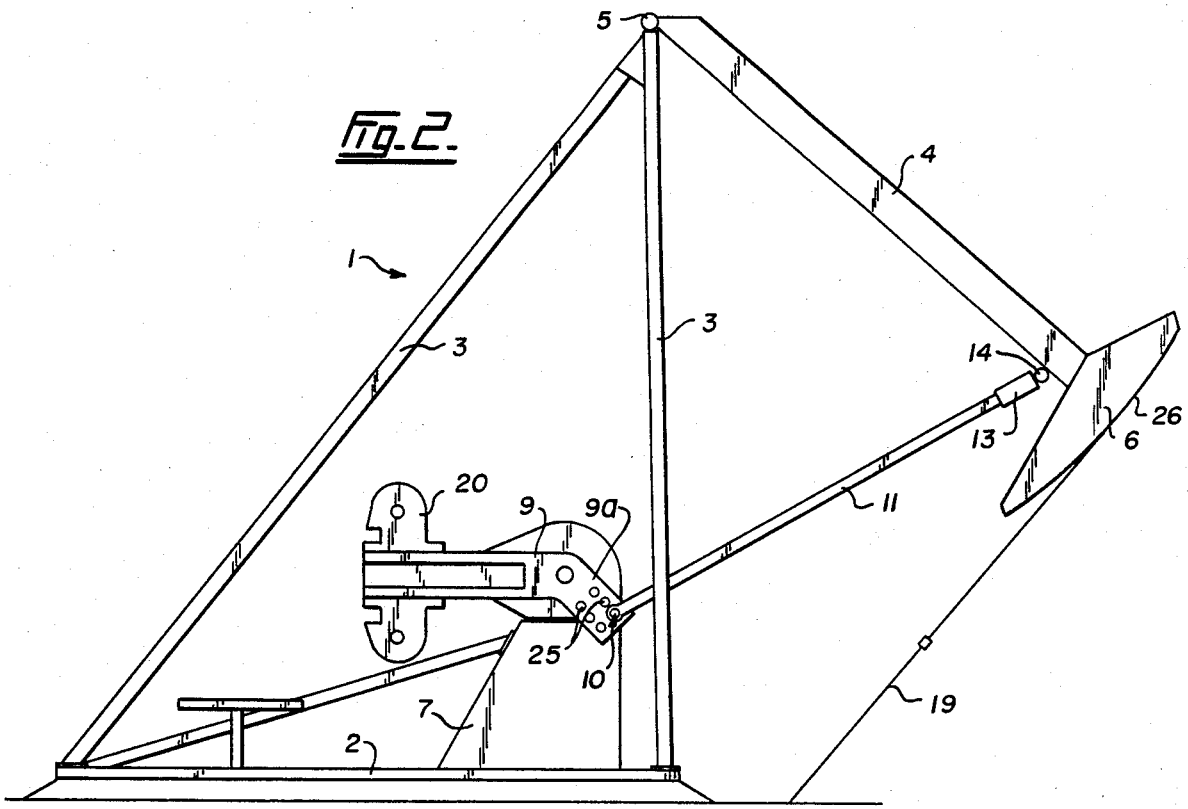
FIG. 2 is a side view of the unit of FIG. 1.

The components used in the pumping unit 1 are conventional, except as otherwise described herein.

The unit 1 comprises a foundation frame 2 and a samson post assembly 3 connected to the frame 2 and extending upwardly therefrom. The tail end of the walking beam 4 is pivotally connected to the samson post assembly 3 by a saddle bearing assembly 5. At its forward end, the walking beam 4 carries a horsehead 6. A gear reducer assembly 7 is mounted on the foundation frame 2 and is driven by a prime mover 8. The gear reducer assembly rotates a pair of crank arms 9, each of which has an offset portion 9*a*. Each crank arm offset portion 9*a* is pivotally coupled by a pin assembly 10 to the lower end of one of the Pitman arms 11. The upper end of each Pitman arm 11 is pivotally coupled by a pin assembly 12 to a yoke 13 which, in turn, is pivotally coupled to the forward end of the walking beam by an equalizer bearing assembly 14.

It will be noted that this previously described assembly is that of a conventional API front-mounted geometry Class III configuration pumping unit for reciprocating a rod string.

In a broad sense, the present invention is grounded on the selection of an API front-mounted geometry Class III configuration pumping unit and combining it with a slanted or angularly disposed walking beam (when viewed at the middle of the stroke on mid-stroke position), to provide a unit particularly well adapted to pump a slanted rod string. Taking this basic combination, we have incorporated preferred features which permit a single production model to be used with wells of different angularity.

MEANS FOR CHANGING THE EFFECTIVE LENGTH OF THE PITMAN ARMS

The pumping unit 1 is modified to permit of adjustment of the effective length of the Pitman arms, to thereby vary the angularity of the walking beam 4.

Figure 6:
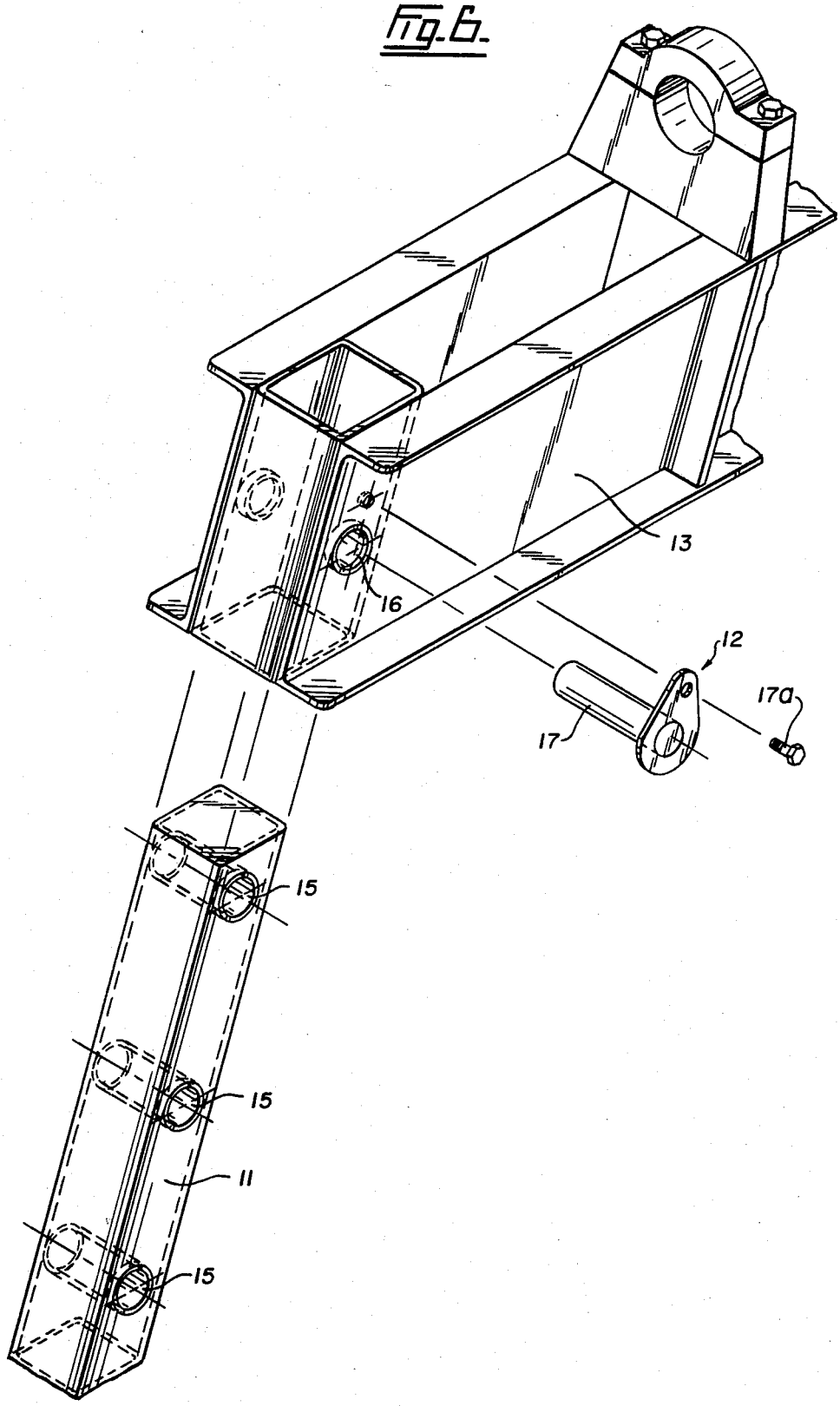
FIG. 6 is a perspective exploded view of the connection at the upper end of the Pitman arm and the walking beam yoke.

Having reference to FIG. 6, this adjustability is achieved by providing a plurality of spaced, transverse pin holes 15 along the length of the upper end of each Pitman arm 11. A pin hole 16 is provided at each end of the yoke 13. A pin assembly 12, comprising a pin 17, extends through each corresponding pair of holes 15, 16, to interconnect the yoke 13 and each Pitman arm 11. The pin 17 is held in place in the yoke 13 by a screw 17*a*.

Figure 3A:
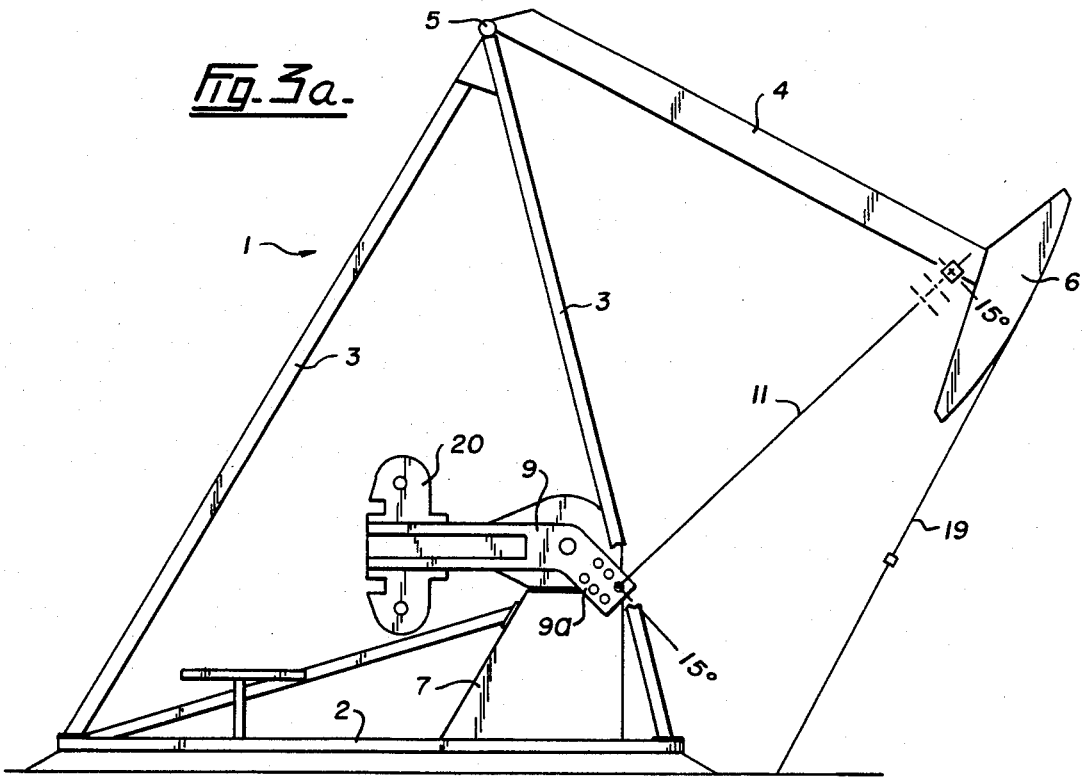
FIGS. 3(*a*), (*b*), and (*c*) are simplified side views of the pumping unit, showing the effective length of the Pitman arms being shortened by changing the location of the interconnection with the walking beam, thereby changing the angularity of said beam from 15° to 25°.
Figure 3B:
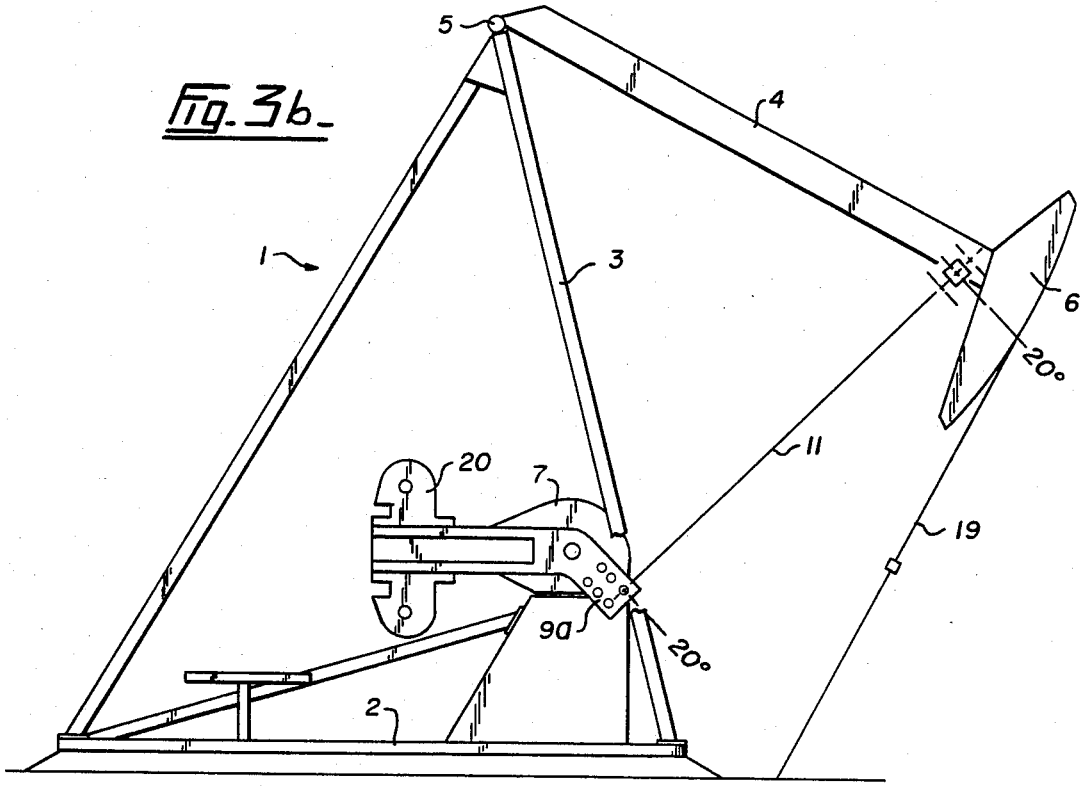
Figure 3C:
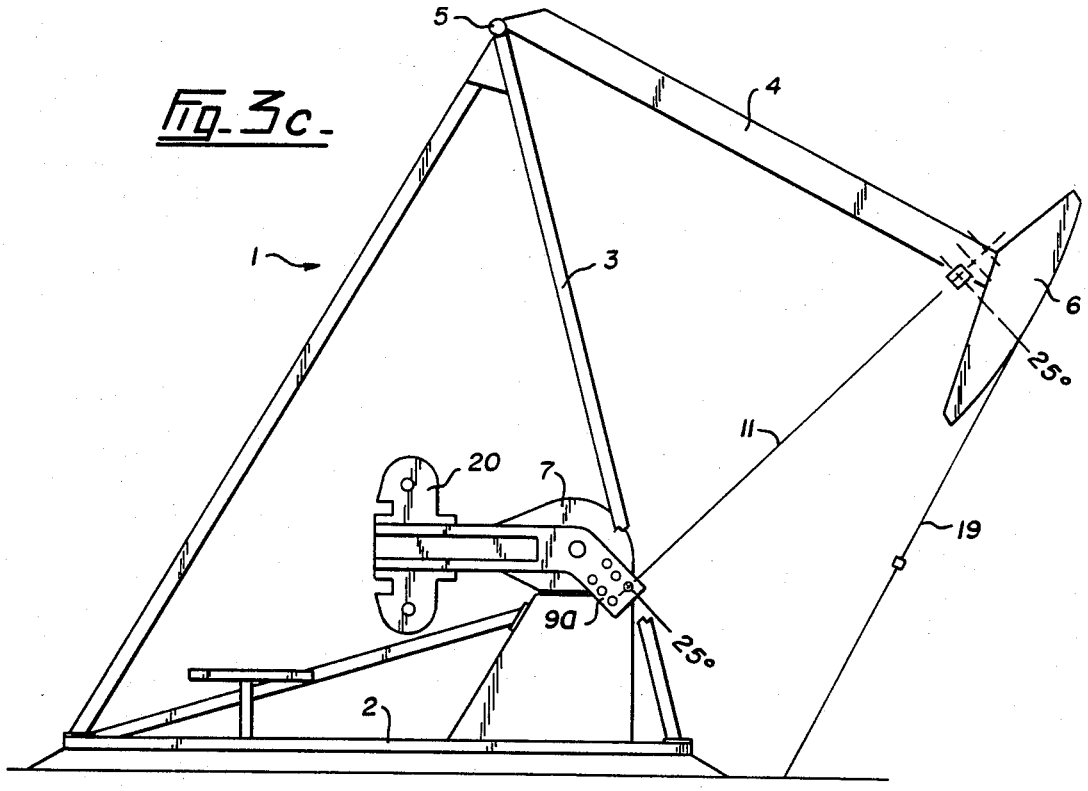
Figure 4A:
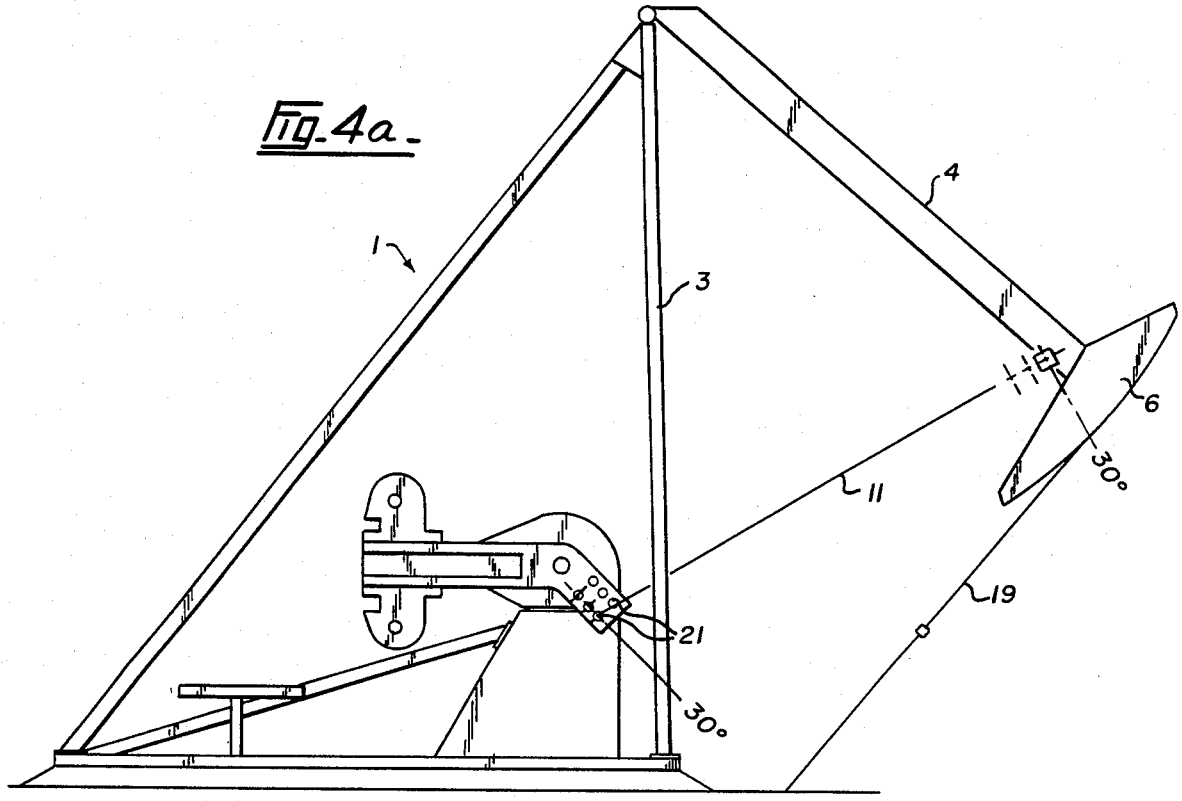
FIG. 4(*a*) is a simplified side view of the pumping unit, showing the lower end of the Pitman arm interconnected with the crank arm at the lower pin hole, for bringing the counterweight into phase.
Figure 4B:
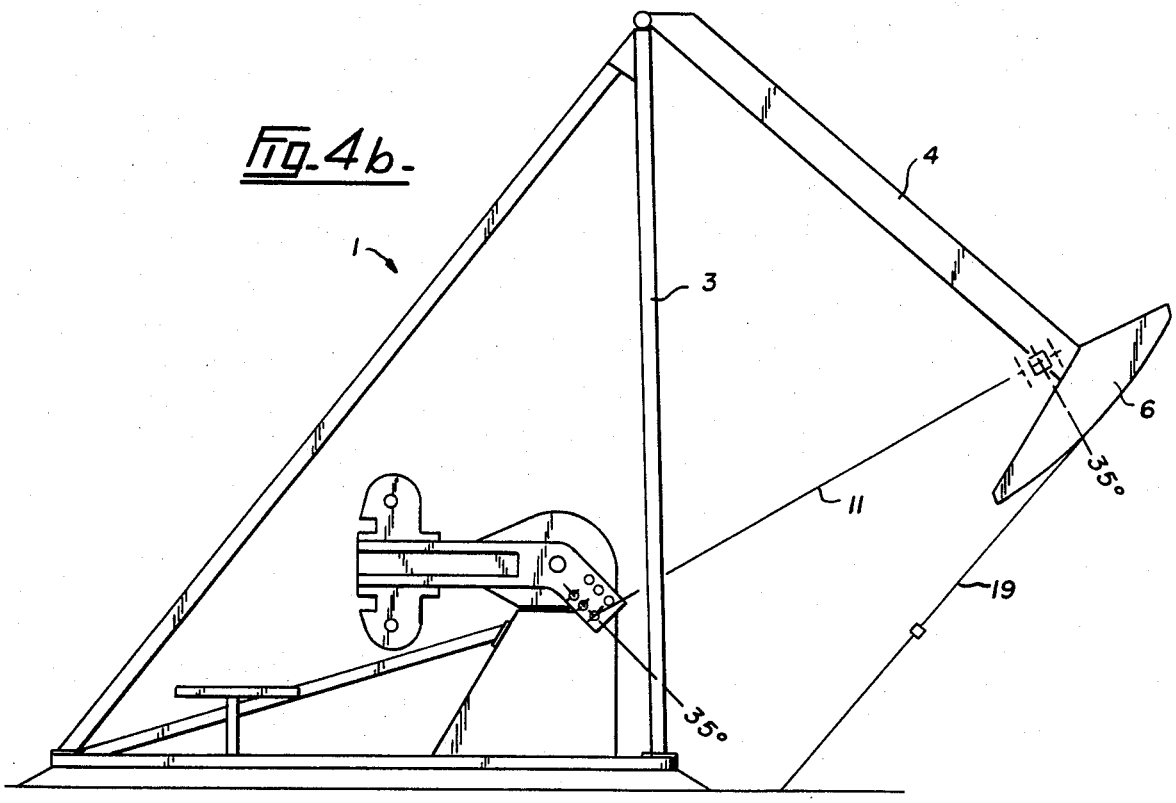
Figure 4C:
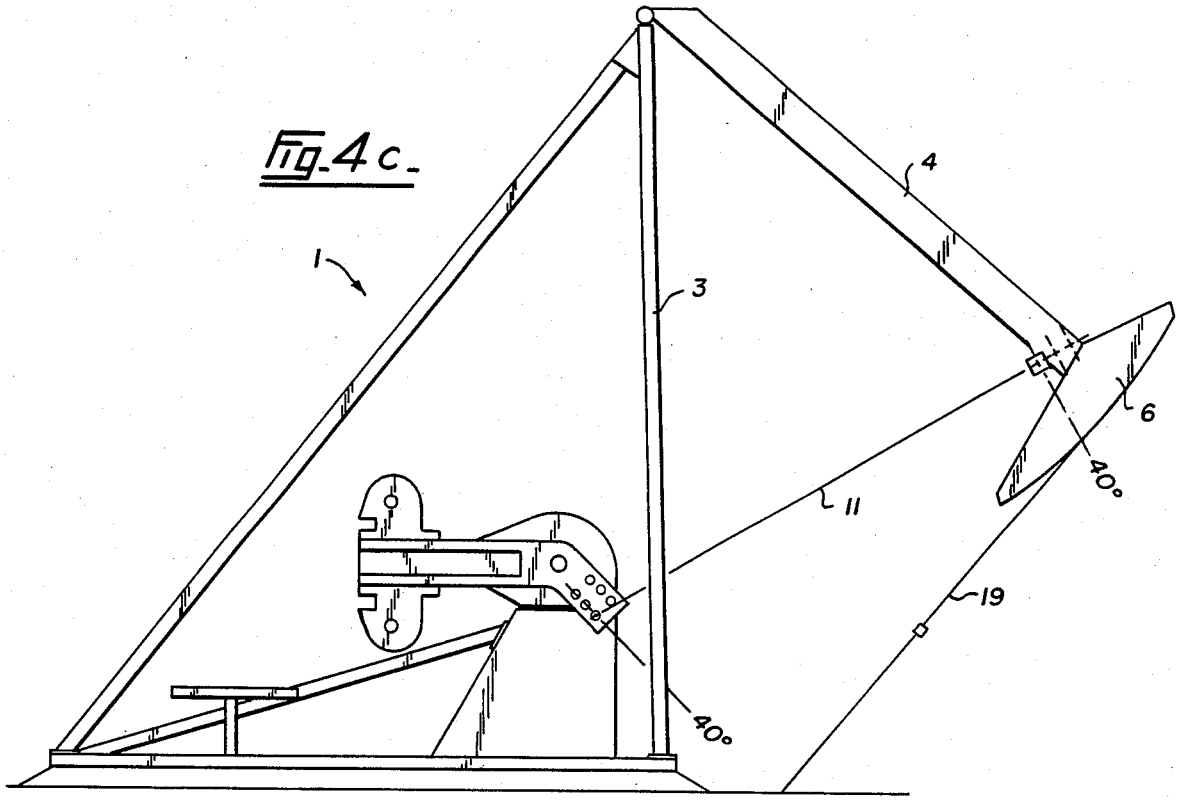
Figure 5:
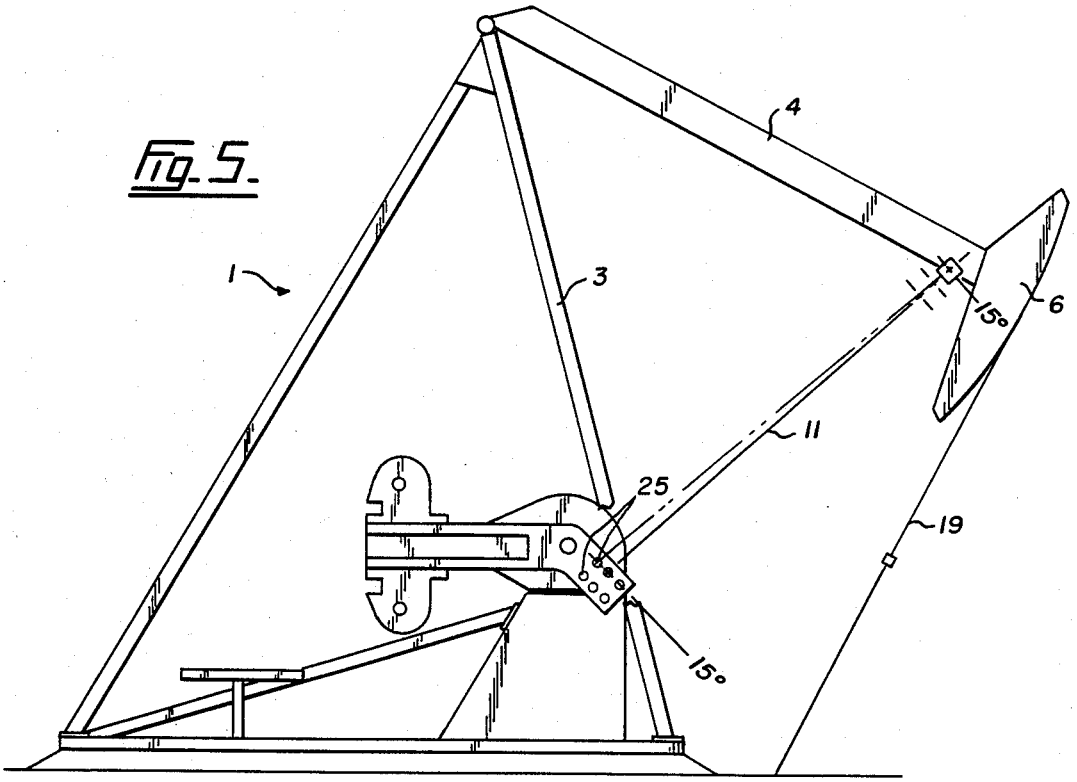
FIG. 5 is a side view of the unit of FIG. 1, showing the connection of the lower end of the Pitman arm having been moved along the crank arm, to alter the stroke length.

It will be understood that the location of the interconnection between the Pitman arms 11 and the walking beam 4 can be adjusted, depending on which pin hole 15 is used to receive the pin 17. By changing the location of the interconnection, the effective length of the Pitman arms 11 is of course changed, which will alter the angularity of the walking beam 4, which will permit the unit 1 to reciprocate a rod string 19 of different slant. This effect is illustrated in FIGS. 3(*a*), (*b*), (*c*).

An alternative means for achieving the same end would be to provide a plurality of pin holes in the yoke ends, said pin holes extending in a row in the direction of the associated Pitman arm.

MEANS FOR BRINGING COUNTERWEIGHT INTO PHASE

The pumping unit 1 is further modified by incorporating means for bringing the counterweight 20 of the unit into phase with the well load for different well angles.

Figure 7:
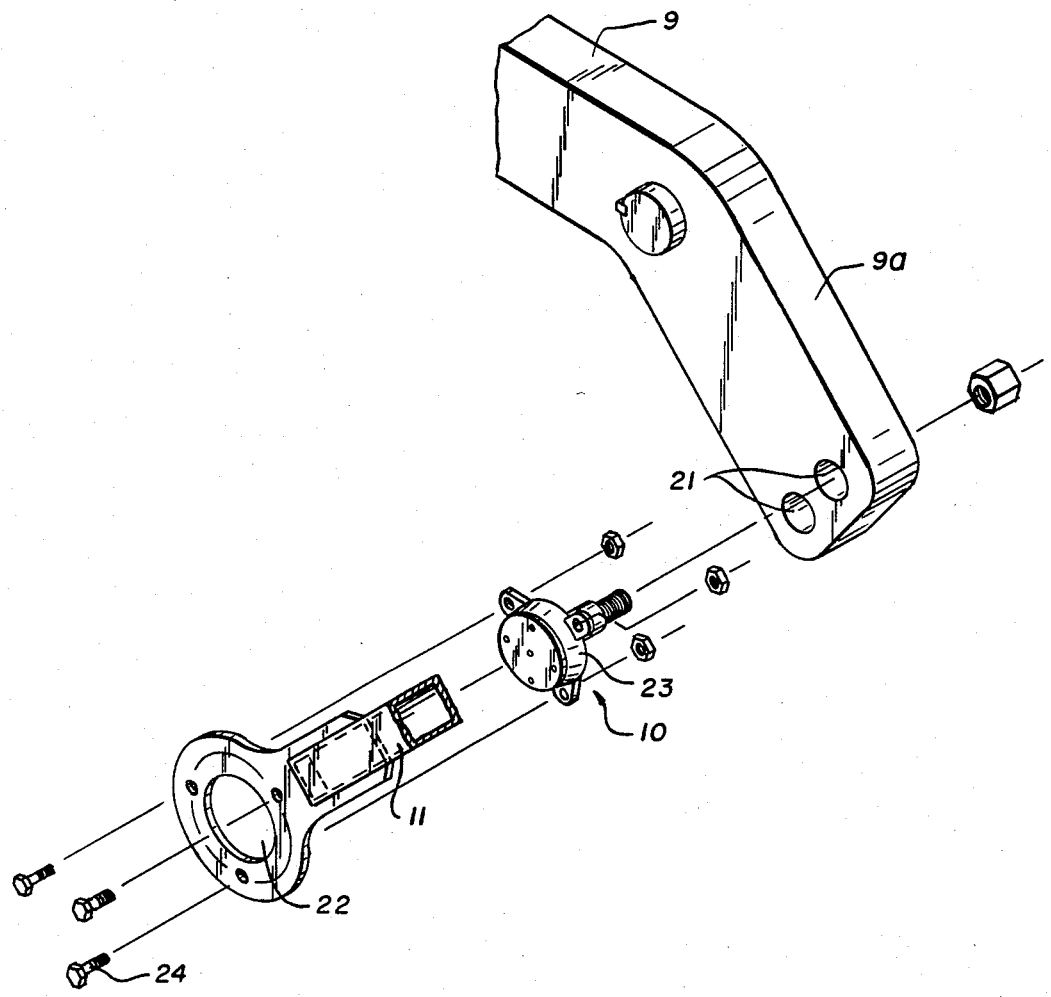
FIG. 7 is a perspective exploded view of the connection at the lower end of the Pitman arm and the crank arm.

With reference to FIG. 7, such means comprise upper and lower spaced transverse pin holes 21 formed in each crank arm offset portion 9*a* along a line generally perpendicular to the longitudinal axis of said offset portion. The lower end of each Pitman arm 11 also has a transverse pin hole 22 extending therethrough. A pin assembly 10, comprising a pin 23 and retaining screws 24, extends through each corresponding pair of holes 21, 22, to interconnect the Pitman arm 11 and crank arm 9.

Moving the location of the interconnection of the Pitman arm and crank arm along the row of holes 21 will alter the operation of the unit so as to bring the counterweight 20 into or out of phase with the well load, depending on the location chosen.

MEANS FOR ALTERING STROKE LENGTH

To complete the versatility of the unit 1, means are incorporated for altering the pumping stroke length.

Such means comprise providing upper and lower rows of pin holes 25 extending from the holes 21 parallel to the longitudinal axis of the crank arm offset portions 9*a*. As a result, the location of the interconnection between the Pitman arm 11 and the crank arm 9 may be shifted along the latter, to cause stroke length to change.

HORSEHEAD

It is desirable that the unit 1 be adapted to handle, without making alterations, rod strings having a slant variation extending over a narrow range, for example 5°. This can be accomplished by using a horsehead 6 having a curved working face 26 which is sufficiently long to maintain a tangential association with the rod string 19 throughout the pumping stroke. Stated otherwise, the face 26 is longer than conventional, so that the unit 1 can be used, without changing any of its other variables, with wells having a variance of angularity within the range (e.g. those wells having angularities within the range 17-½°-22-½°).

In sum, the preferred embodiment shown is capable of efficiently pumping a slant rod string and a single unit can be adjusted as to slant, counterbalancing, and stroke length, to thereby be used with a wide variation of slant wellbores.

The scope of the invention is defined by the following claims.

The embodiments of the invention in which an exclusive property or privilege is claimed are defined as follows:

1. In a pumping unit for reciprocating a rod string in a wellbore which is slanted at an angle from vertical, said unit having a Samson post assembly, a walking beam pivotally mounted at its rear end on the Samson post assembly, a pair of Pitman arms, pivotally connected at their upper ends to the front end of the walking beam by a pin and hole means, for supporting said beam and rocking it through a predetermined stroke, rotating crank arms for biasing said Pitman arms, said crank arms each being pivotally connected at one end by pin and hole means to the lower end of one of the Pitman arms, the length of the Pitman arms between their pivot connections with the walking beam and the crank arms being their effective length, counterweight means attached to the crank arms at the latter's ends remote from the Pitman arms connection, and means for rotating said crank arms, the improvement comprising:

said walking beam being disposed downwardly at an angle from horizontal when said beam is at the mid-point of its stroke;

one of said walking beam and pair of Pitman arms having a plurality of pin holes formed in spaced apart arrangement along a plane generally coinciding with the axis of the Pitman arms, whereby the effective length of the Pitman arms may be adjusted by altering the location of the pins interconnecting the Pitman arms with the walking beam, to thereby vary the downward angle of the walking beam.

2. The improvement as set forth in claim 1 wherein:

said crank arms each have an angularly offset portion forming a plurality of pin holes therealong, whereby the position of the pin interconnecting each crank arm and associated Pitman arm can be varied to bring the counterbalance torque substantially into phase with the well load.

3. The improvement as set forth in claim 1 wherein:

each Pitman arm forms a plurality of pin holes spaced along the length of its upper end, for permitting of the adjustment of the effective length of said Pitman arms.

4. The improvement as set forth in claim 2 wherein:

each Pitman arm forms a plurality of pin holes spaced along the length of its upper end, for permitting of the adjustment of the effective length of said Pitman arms.

* * * * *